United States Patent [19]

Erickson et al.

[11] 4,131,704

[45] Dec. 26, 1978

[54] NONWOVEN FABRIC COMPRISING NEEDLED AND SELECTIVELY FUSED FINE AND COARSE FILAMENTS HAVING DIFFERING SOFTENING TEMPERATURES WHICH IS USEFUL AS A BACKING IN THE PRODUCTION OF TUFTED MATERIALS

[75] Inventors: Wayne K. Erickson; John P. Walters, both of Greenville, S.C.

[73] Assignee: Phillips Petroleum Company, Bartlesville, Okla.

[21] Appl. No.: 646,098

[22] Filed: Jan. 2, 1976

[51] Int. Cl.[2] ..... B32B 5/06; B32B 5/08; B32B 5/12; D04H 1/48

[52] U.S. Cl. ..... 428/95; 28/112; 428/288; 428/296; 428/297; 428/301; 428/303

[58] Field of Search ..... 428/300; 428/95, 296, 428/297, 300, 301, 303, 288; 28/72.2 R

[56] References Cited

U.S. PATENT DOCUMENTS

| | | | |
|---|---|---|---|
| 3,392,079 | 7/1968 | Fekete | 428/300 |
| 3,476,636 | 11/1969 | Crosby | 428/95 |
| 3,884,169 | 5/1975 | Hoppe et al. | 428/95 |

*Primary Examiner*—J.C. Cannon

[57] ABSTRACT

A nonwoven fabric is comprised of a blend of fine staple fibers and coarse staple fibers randomly oriented with the fine staple fibers having a higher melt flow than the coarse staple fibers. In the manufacture of the nonwoven fabric, same is needled whereby the needles select the fine fibers and portions of same are positioned in a plane generally transverse to the plane of the fabric. Infrared heat is used to fuse the fine fibers at overlapping portions thereof to provide integrity for the fabric. The coarse staple fibers are held in the interstices of the fabric at least partially by frictional engagement with the fine staple fibers.

10 Claims, 5 Drawing Figures

NONWOVEN FABRIC COMPRISING NEEDLED AND SELECTIVELY FUSED FINE AND COARSE FILAMENTS HAVING DIFFERING SOFTENING TEMPERATURES WHICH IS USEFUL AS A BACKING IN THE PRODUCTION OF TUFTED MATERIALS

New uses are being developed for nonwoven fabrics, a major use of which is as a primary and/or secondary backing for a carpet. Traditionally, jute has been used as a backing material for carpets but because of the lack of reliability in the supply of jute, substitutes have had to be developed. It has been found that nonwoven fabric can be used successfully but some of these fabrics have had a tendency toward excessive shrinkage during carpet manufacture and failure of the backing to retain the tufted pile secured to the backing because of fiber breakage. In the use of nonwoven fabrics for carpet backing, the integrity of the fabric is normally maintained by fusing or bonding portions of the fibers together. Tufting the pile in such a backing to form a carpet requires excessive tufting force because the fibers are less capable of moving relative to one another to allow the tufting to be inserted through the carpet backing. This also leads to excessive tufting noise plus weakening of the carpet backing.

The principal objects and advantages of the present invention are: to provide a nonwoven fabric which is useable as a carpet backing or the like which overcomes the above-mentioned difficulties; to provide such a fabric which is easy to manufacture with currently available equipment requiring a minimum of equipment modification; to provide such a fabric which is well adapted for its intended use; and to provide a method of manufacturing a non-woven fabric wherein the produced fabric requires reduced needling force for tufting.

Other objects and advantages of the present invention will become apparent from the following description taken in connection with the accompanying drawings wherein are set forth by way of illustration and example certain embodiments of the present invention.

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting but merely as a basis for the claims and as a representative basis for teaching one skilled in the art to variously employ the present invention in virtually any appropriate detailed structure.

Figure 1:
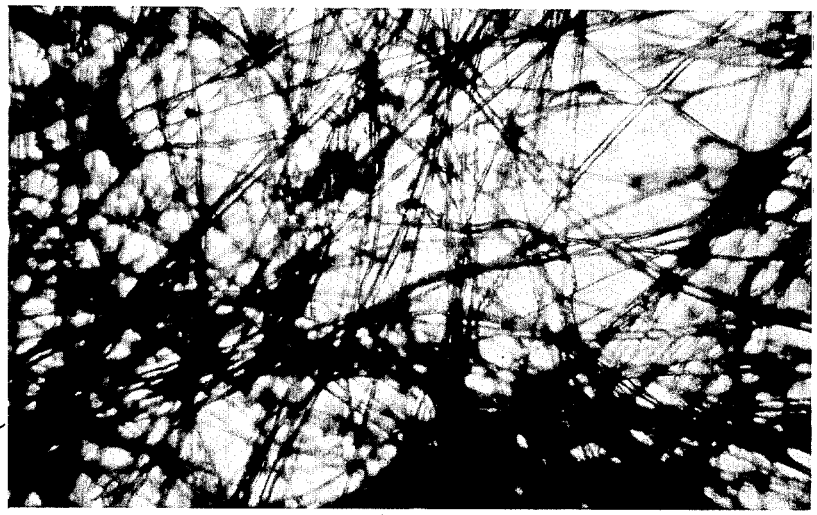
FIG. 1 is a top view of a nonwoven fabric shown magnified approximately 50×.
Figure 2:
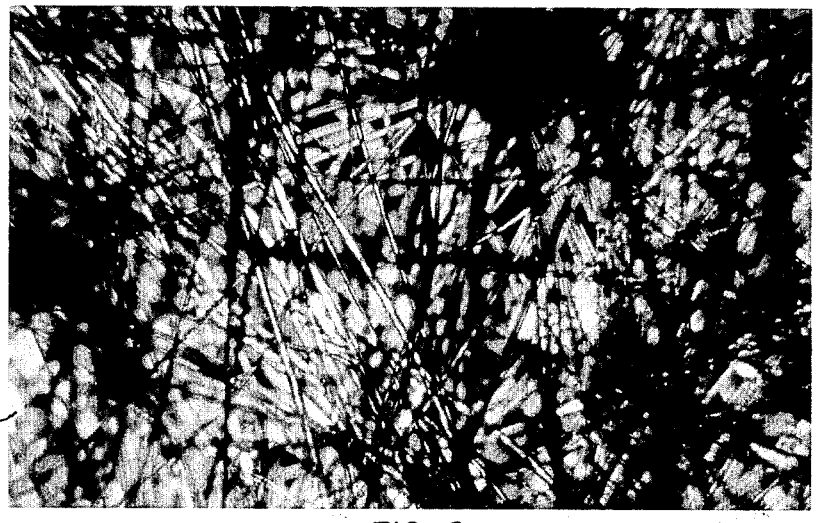
FIG. 2 is a bottom view of the fabric shown in FIG. 1 magnified approximately the same amount.
Figure 3:
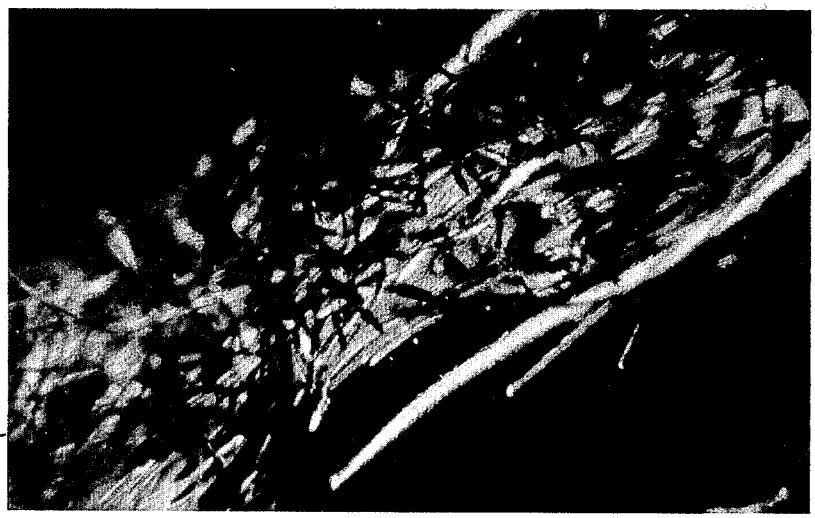
FIG. 3 is an edge view of the fabric shown in FIGS. 1 and 2 and is magnified approximately 50×.

The reference numeral 1 designates generally a nonwoven fabric comprised of a blend of fine staple fibers and coarse staple fibers, both of which are randomly oriented within the network of the fabric 1. The fibers are of a synthetic material such as polypropylene and copolymers thereof, with the coarse fibers being of a denier at least twice the denier of the fine fibers. The use of the word "denier" herein is interpreted to mean fiber denier value is based on the assumption that the materials of the fibers have the same density. In other words, denier is used as a measure of the relative cross-sectional areas of the particular fibers. The fine fibers are selectively needled instead of the coarse fibers whereby portions of the fine fibers extend generally transverse to the plane of the fabric as can be seen in FIG. 3 with the fine fibers being those that are darker. Also, the fine fibers are fused at overlapping portions thereof to provide integrity for the nonwoven fabric.

The material of the coarse fibers can be of the same material or the fine fiber can be of one material and the coarse fiber can be of another material to help provide for the selective fusing or bonding of the fine fibers. To accomplish this, the fine fibers have a higher melt flow than the coarse fibers. This difference should be at least 10 melt flow units as measured by ASTM D1238-65T condition L. This, then, means that the fine fibers have a lower softening temperature whereby same will fuse or bond together in preference to bonding or fusing of the coarse fibers. However, proper selection of the fusing temperature will allow a certain limited amount of fusing and/or mechanical bonding between the fine fiber and the coarse fiber when the fabric is produced by the method described below. However, the majority of the length of the coarse fibers is unfused to the fine fibers and thereby allows the coarse fibers to move within the interstices of the fabric. The coarse fibers are also held within the interstices of the fabric by frictional engagement with fine fibers and other coarse fibers.

The coarse fibers are preferably of a longer length than the fine fibers as for example, about 5 to 8 inches and preferably 6 to 7 inches (15 cm.) or longer, while the fine fibers are about 1½ to 5 inches and preferably 3 to 4 inches (10 cm.). The use of long fibers provides more strength for the fabric and also results in a fabric having decreased elongation and the use of the fine fibers in connection with the coarse fibers provides for better cover with less material fibers when the nonwoven fabric is in use as for example as a primary or secondary carpet backing.

As described above, when needling of the nonwoven fabric during manufacture, a proper selection of barb size on the needles results in selection of the fine fibers in preference to the coarse fibers wherein certain portions of the fine fibers extend generally transverse to the plane of the fabric to help provide integrity for same after fusing. By proper selection of the coarse fiber cross-sectional area, same will not be selected by the needles during needling wherein same will lie in a plane substantially parallel to the plane of the fabric. Because of the selective fusion by the proper selection of melt flows for the respective fibers, the coarse fibers are relatively free to move within the interstices of the fabric which when the fabric is used, as for example for a carpet backing, the tufting force can be reduced. Four fabrics having substantially the same weight of fibers were made and the tufting force measured is shown in the following table:

| Fibers Used in Fabric | Polymer | Melt Flow** | Method of Fusion | Needle Force Required for Tufting |
|---|---|---|---|---|
| 3 DPF-4 in. (10 cm.) | poly-propylene | 20 | Infrared heat fused | 4–4.5 lbs (1.80–2.025 kg) |
| 3 DPF-4 in. | poly- | 20 | Roll fused | 3–3.5 lbs |

-continued

| Fibers Used in Fabric | Polymer | Melt Flow** | Method of Fusion | Needle Force Required for Tufting |
|---|---|---|---|---|
| (10 cm.) | propylene | | | (1.35–1.575 kg) |
| 12 DPF-6 in. (15 cm.) | poly-propylene | 8 | Infrared heat fused | 1–1.5 lbs* (.45–.675 kg) |
| 3 DPF-4 in. (10 cm.) | poly-propylene | 20 | | |
| 12 DPF-6 in. (15 cm.) | poly-propylene | 8 | | |
| (A blend of 50% of each of the above fibers) | | | Infrared heat fused | 2 lbs (.90 kg) |

*Cover and distribution were poor for the 12 DPF fabric. The other fabrics exhibited adequate cover.
**ASTM D1238-65T Condition L.

The above table shows that fabric produced according to the teaching of the present invention provides a fabric which requires reduced needling force while still providing good cover and fiber distribution within the fabric. The blend should have between 25 percent and 75 percent by weight of fine staple fiber and 75 to 25 percent by weight of the coarse staple fiber in the blend of fibers used to produce the above-described fabric.

Figure 5:
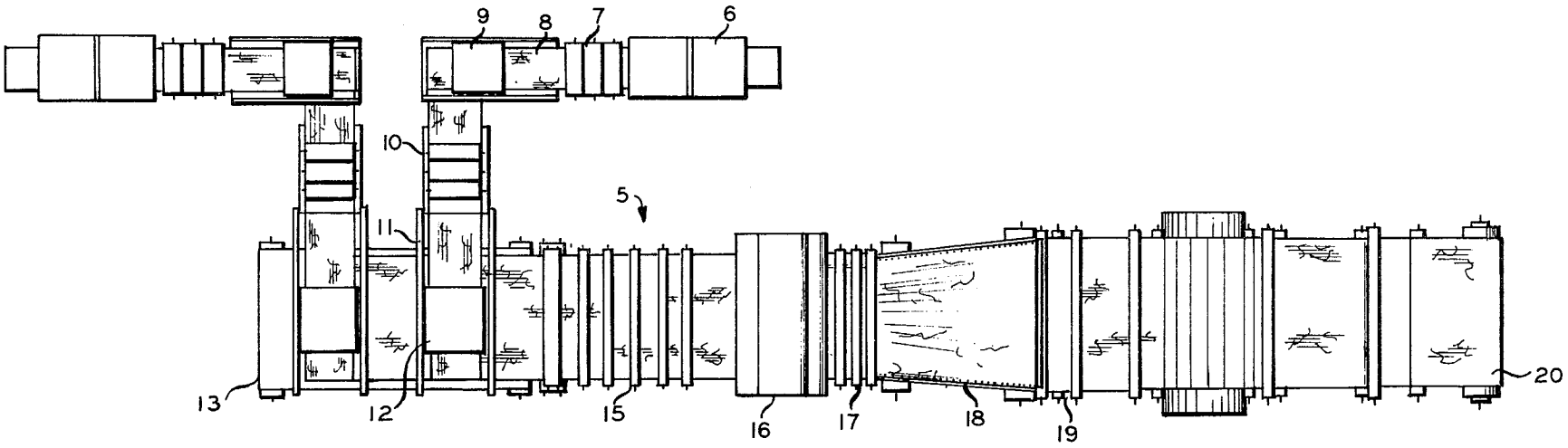
FIG. 5 is a plan view of an apparatus used to produce a nonwoven fabric.

The above-described fabric can be produced on substantially conventional equipment used to make nonwoven fabric such as the apparatus shown in FIG. 5. It is to be understood that modifications or additions to the equipment described can be provided and still produce the above-described fabric. As shown, the reference numeral 5 designates generally an apparatus for producing nonwoven fabric wherein feed means 6 such as bale breakers, blender boxes, feed boxes, etc., feed fibers in the form of staple to a breaker carding machine 7. Carded webs 8 of fibers proceed to crosslappers 9 to form intermediate bats. These intermediate bats are then passed to a finisher carder 10 to produce carded webs which are then picked up by crosslappers 11. The above-described elements are well known in the art of manufacturing nonwoven fabrics. The carded webs are then fed onto lapper aprons 12 wherein the fibers are then dispersed on a floor apron 13. As shown, two of the above-described portions of the apparatus 5 are provided to make a thicker web from which a nonwoven fabric is made. However, one or any other suitable number of the above-described portions of the apparatus 5 can be provided. The web passes from along the floor apron 13 to nip rollers 15 wherein the web is drafted in the machine or warp direction and then the web is passed to a needler 16. The needler then needles the web and by proper selection of a needle barb size the fine fibers are selected in preference to the coarse fibers wherein portions of the fine fibers are needled through the fabric wherein portions of the fine fibers are generally transversed to the plane of the fabric as described above. After exiting the needler 16, the web passes through further nip rollers 17 for more machine direction drafting of the web. The drafted web after exiting the nip roller 17 then passes to a tenter frame 18 for drafting of the web in a direction transverse to the machine direction. While passing along the tenter frame, and while being maintained in a stretched condition, the web is subjected to infrared heat from an infrared heater 19 to effect the fusing or bonding of the fine fibers to one another and occasionally to the coarse fibers as is described above. From the tenter frame the fused fabric is cooled and the trim and the edges are trimmed after which the fabric is removed from the apparatus by take-up means 20. The above described portions of the apparatus 5 are well known in the art of fabric manufacturing and details of same are therefore not disclosed in detail herein.

Figure 4:
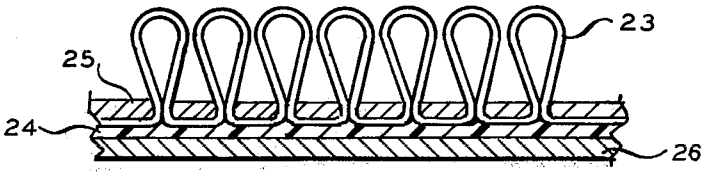
FIG. 4 is an edge view of the fabric as used to form a carpet backing and having pile inserted therein.

The fabric as disclosed above is useful as a primary or secondary carpet backing and as such same can be processed in conventional carpet manufacturing apparatus for tufting the fabric with yarn or fabric as is known in the art. By having the coarse fibers of the above-described fabric relatively free to move within the interstices of the fabric the coarse fibers can move out of the way of the tufting needles and thereby reduce the amount of force required to effect the tufting. Because of the slight amount of bonding of the coarse fibers to the fine fibers, same are retained within the interstices of the fabric to help retain the tufted yarn on the carpet backing. The tufts 23 can be of any suitable type such as that used in carpets having loop or cut piles or any other type known in the art. As seen in FIG. 4, a typical carpet construction would be comprised of a primary layer 25 of fabric 1 tufted yarn 23 extending therethrough, a latex coating 24, and a secondary layer 26 of fabric 1 adhered to the latex.

It is to be understood that while we have illustrated and described certain forms of our invention, it is not to be limited to the specific form or arrangement of parts herein described and shown.

What is claimed and descired to be secured by Letters Patent is:

1. A tufted pile fabric comprising:

(a) a primary backing of fine staple fibers and coarse staple fibers including:

(1) 75 to 25 percent by weight of said fine staple fibers of polypropylene having a lower softening temperature than that of said coarse fibers, thereby permitting the selective fusing of fine staple fibers in preference to fusing of coarse staple fibers, said fine staple fibers being randomly oriented in the plane of the backing, said fine staple fibers having portions thereof extending in a direction generally transverse to the plane of the backing, overlapping portions of said fine staple fibers being selectively fused together to provide integrity for the fabric.

(2) 25 to 75 percent by weight of coarse staple fibers of polypropylene having a denier at least twice that of the fine fibers, said coarse staple fibers being randomly oriented and intermixed with the fine staple fibers, and coarse staple fibers being in a plane substantially parallel to the plane of the backing and being retained in the interstices of the fine staple fibers by frictional engagement with the fine staple fibers with a major portion of the length of the coarse staple fibers being free of fusion bonding to thereby allow said coarse staple fibers to move within said interstices; and (b) tufted yarns piercing said primary backing; and (c) a secondary backing adhered to said tufted primary backing.

2. The fabric as set forth in claim 1 wherein portions of said fine fibers overlap portions of said coarse fibers and certain of these overlapping portions are bonded together.

3. A nonwoven fabric comprised of a plurality of different types of staple fibers, said fabric including:

(a) 75 to 25 percent by weight of fine staple fiber of synthetic material randomly oriented in the plane of the fabric with said fine staple fibers having portions thereof extending in a direction generally transverse to the plane of the fabric, overlapping portions of said fine staple fibers being selectively fused together to provide integrity for the fabric;

(b) 25 to 75 percent by weight of coarse staple fibers having a denier of at least twice that of the fine staple fibers, of synthetic material having a higher softening temperature than the softening temperature of the fine staple fibers, thereby permitting the selective fusing of fine staple fibers to fine staple fibers in preference to fusing of coarse staple fibers, said coarse staple fibers being randomly oriented in the plane of the fabric and intermixed with the fine staple fibers, said coarse staple fibers being positioned in a plane substantially parallel to the plane of the fabric and being at least partially retained in the interstices of the fine staple fibers by frictional engagement with the fine staple fibers, said coarse staple fibers have a major portion of their length free of fusion bonding to thereby allow said coarse staple fibers to move within said interstices.

4. The fabric as set forth in claim 3 wherein portions of said fine fibers overlap portions of said coarse fibers and certain of these overlapping portions are bonded together.

5. The fabric as set forth in claim 3 wherein said fine fiber has a melt flow of at least about 10 units above that of said coarse fibers and both coarse and fine fibers are polypropylene.

6. The fabric as set forth in claim 5 wherein said fine fibers have a length in the range of about 1½ inches to about 5 inches and said coarse fibers have a length in the range of about 5 inches to about 8 inches.

7. A nonwoven fabric comprised of a plurality of different types of staple fibers, said fabric including:

(a) 75 to 25 percent by weight of fine staple fibers of synthetic material randomly oriented with said fine staple fibers having portions thereof extending in a direction generally transverse to the plane of the fabric, overlapping portions of said fine staple fibers being fused together, said fine staple fibers having a length of about 4 inches;

(b) 25 to 75 percent by weight of coarse staple fibers having a denier of at least twice that of the fine staple fibers, of synthetic material having a lower melt flow than the melt flow of the fine staple fibers with said coarse staple fibers being randomly oriented and intermixed with the fine staple fibers, said coarse staple fibers being oriented in a plane substantially parallel to the plane of the fabric and being at least partially retained in the interstices of the fine staple fibers by frictional engagement with the fine staple fibers, said coarse staple fibers having a length of about 6 inches, said fine staple fibers having a melt flow of at least about 10 units above that of said coarse staple fibers as measured by ASTM D1238-65T condition L, thereby permitting selective fusing of fine staple fibers to fine staple fibers in preference to fusing of coarse staple fibers, the synthetic material of the fine staple fibers and the synthetic material of the coarse staple fibers being polypropylene.

8. A method of making a nonwoven fabric, said method including the steps of:

(a) forming a web of intermixed and randomly oriented fibers of which 75 to 25 percent is fine staple fibers of synthetic material and 25 to 75 weight percent is coarse staple fibers of synthetic material having a denier of at least about twice that of the fine fibers, said coarse fibers having a higher softening temperature than that of the fine fibers;

(b) needling said web with needles having a barb size sufficiently small for selectively needling the fine fibers in preferance to the coarse fibers whereby portions of the fine fibers extend in a direction generally transverse to the plane of the fabric and said coarse fibers are generally parallel to the plane of the fabric; and (c) heating the needled web to a temperature sufficient to selectively bond the fine fibers together at overlapping portions thereof in preference to bonding the coarse fibers, with the majority of the length of the coarse fibers being free of fusion bonding and movable within the interstices of the fine fibers and held therein by friction.

9. The method as set forth in claim 8 wherein portions of said fine fibers overlap portions of said coarse fibers and certain of these overlapping portions are bonded together.

10. The method as set forth in claim 8 wherein said fine fibers have a melt flow of at least about 10 units above that of said coarse fibers and both fibers are polypropylene.

* * * * *